US006034479A

United States Patent [19]

Xia

[11] Patent Number: 6,034,479

[45] **Date of Patent: *Mar. 7, 2000**

[54] SINGLE PIXEL TESTER FOR FIELD EMISSION DISPLAYS

[75] Inventor: Zhongyi Xia, Boise, Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/959,785

[22] Filed: Oct. 29, 1997

[51] Int. Cl.[7] ..... G09G 3/10

[52] U.S. Cl. ..... 315/169.1; 315/169.3; 315/169.2; 345/185; 345/204

[58] Field of Search ..... 315/169.1, 169.2, 315/169.3, 169.4; 345/185, 200, 204, 90, 55, 213

[56] References Cited

U.S. PATENT DOCUMENTS

| | | | |
|---|---|---|---|
| 5,347,201 | 9/1994 | Liang et al. | 315/366 |
| 5,357,172 | 10/1994 | Lee et al. | 315/167 |
| 5,387,844 | 2/1995 | Browning | 315/169.3 |
| 5,402,143 | 3/1995 | Ge et al. | 345/102 |
| 5,410,218 | 4/1995 | Hush | 315/169.1 |
| 5,438,240 | 8/1995 | Cathey et al. | 315/169.1 |
| 5,459,480 | 10/1995 | Browning et al. | 345/75 |
| 5,578,906 | 11/1996 | Smith | 315/169.3 |
| 5,605,483 | 2/1997 | Takeda et al. | 445/2 |
| 5,638,085 | 6/1997 | Hush et al. | 345/74 |
| 5,748,167 | 5/1998 | Watanabe et al. | 345/98 |
| 5,751,262 | 5/1998 | Browning et al. | 345/75 |
| 5,940,052 | 8/1999 | Xia et al. | 345/74 |

OTHER PUBLICATIONS

Browning, "Field Emission Display Development and Testing", *Eighth International Vacuum Microelectronics Conference*, Jul. 30–Aug. 3, 1995.

*Primary Examiner*—Haissa Philogene
*Attorney, Agent, or Firm*—Nixon & Vanderhye P.C.

[57] ABSTRACT

A single pixel driving circuit generates a time sequence signal necessary to turn on a single pixel at a time in a field emission display device wherein an anode current measuring circuit for measuring the anode current for each single pixel is connected between the high voltage supply line and the field emission display anode. The anode current measuring circuit is synchronized with the display driving circuits such that a computer controls each of the drive and measuring circuits. Moreover, by way of computer control of the driving circuits and a clock generator for synchronizing the drive and measurement circuits, both high speed production mode testing and relatively slow speed engineering mode testing can be conducted. The measured anode current values for each single pixel are thereafter stored as to their value or waveform, as well as the location of the respective pixels.

27 Claims, 5 Drawing Sheets

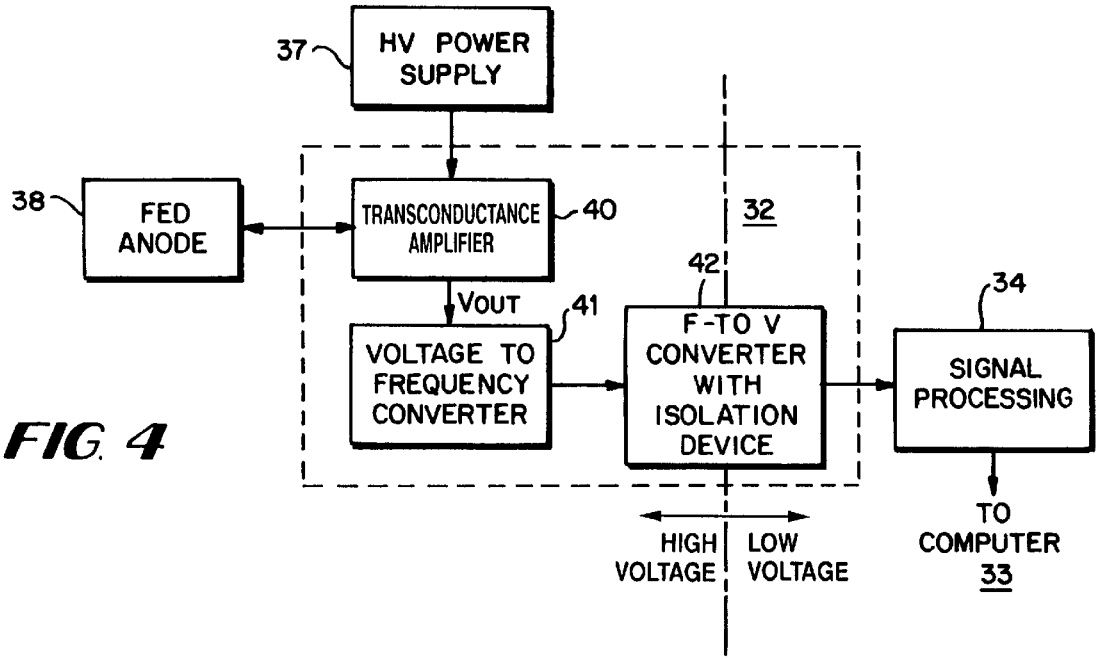
FIG. 4
FIG. 5
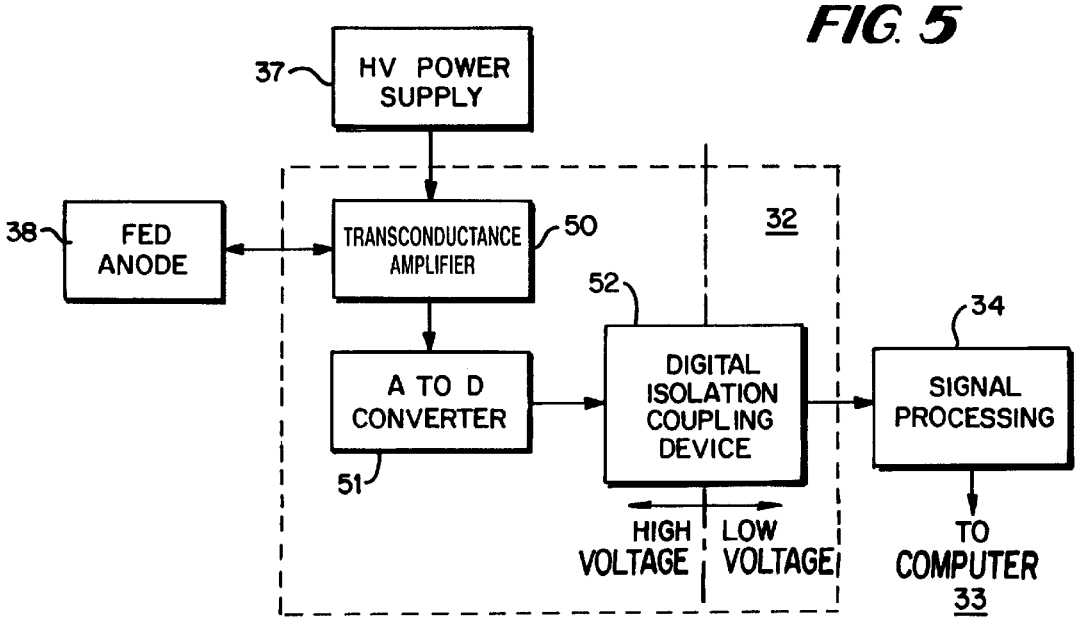

SINGLE PIXEL TESTER FOR FIELD EMISSION DISPLAYS

This invention was made with government support under Contract No. DABT 63-93-C-0025 awarded by Advanced Research Projects Agency (ARPA). The government has certain rights in this invention.

FIELD OF THE INVENTION

The present invention pertains to testing of field emission displays. More particularly the invention relates to the measurement of single pixel anode current in field emission displays.

BACKGROUND OF THE INVENTION

Display devices such as cathode ray tubes and liquid crystal displays are well known image display devices as are their characteristics. Cathode ray tubes, for example, are known to have good characteristics with respect to color, brightness, contrast and resolution but are bulky and consume relatively large amounts of power. In contrast liquid crystal displays are relatively compact and provide flat panel displays useful in lap top computers and the like. However, such liquid crystal devices provide relatively poor contrast in comparison with cathode ray tube displays and provide only a limited angular display range. Moreover, color liquid crystal display devices consume power at rates incompatible with extended battery operation.

More recently, thin film field emission displays (FEDs) have become increasingly important for applications requiring light weight portable screens with good display characteristics. Passive FED devices in the elementary form as illustrated in FIG. 1 conventionally include a substrate 11 onto which a resistive material layer 12 is deposited for providing current limit resistor for field emission tip 13. Surrounding the emitter tip 13 is an extraction gate or grid structure 15 which is supported by insulating layer 14. A screen comprising a glass layer 16, a transparent conductive layer 17 and phosphors 18 function as the high voltage anode. When the voltage source provides the illustrated relative potential differences, an electron stream is emitted by the emitter 13 toward the phosphor coated screen so as to provide the illustrated luminescent display.

In more detail FIG. 2 illustrates a cross-sectional view of a portion of a flat panel field emission display wherein a single display segment 2 is shown. Each such display segment is capable of displaying a pixel of information or a portion of a pixel. In this regard a pixel may include one or a plurality of emitters depending on the size and type of display. For example, one or more emitters may be applied to each of a red-green-blue full-color triad pixel. The elements depicted in FIG. 2 generally cooperate in the manner noted above with regard to the structure of FIG. 1 and the same numerical labeling has been applied to corresponding elements found in both FIGS. 1 and 2. However, since proper functioning of the emitter tips requires operation in a vacuum, FIG. 2 further shows the use of spacers 19 for supporting the screen 16 over the base assembly against atmospheric pressure. Moreover, the cathode base electrodes 12 are illustrated as being patterned for the purpose of obtaining selectable activation of a display segment or pixel such that the controller 24 can establish a voltage differential between the selected emitter tips and the anode structures through the use of a matrix of pixels that are addressable via column and row control signals.

Various techniques and drive circuits are known for selectable activation of the emitters associated with a pixel.

For example, the base electrode conductors 12 could be arranged in rows and the grid 15 arranged in columns perpendicular to the rows of cathode base electrodes. Controller 24 would apply appropriate row address signals to the cathode base electrodes and column control address signals to the grid column segments connected to appropriate voltage potentials to selectively activate the emitters of the desired pixel. Suitable pixelator drive circuitry for the rows and columns is known in the art and is disclosed, for example, in commonly owned U.S. Pat. No. 5,438,240 issued Aug. 1, 1995 to Cathey et al and U.S. Pat. No. 5,410,218 issued Apr. 25, 1995 to Hush which are hereby incorporated by reference in their entirety.

Alternatively, the base electrode conductors 12 may be patterned so as to be arranged as a matrix which is addressable via column and row control signals to selectively switch appropriate voltages so as to activate the emitter tips of a selected pixel. Driving circuits for use with the alternative arrangement are disclosed, for example, in commonly owned U.S. Pat. No. 5,357,172 issued Oct. 18, 1994 to Lee et al, U.S. Pat. No. 5,387,844 issued Feb. 7, 1995 to Browning and U.S. Pat. No. 5,459,480 issued Oct. 17,1995 to Browning et al. These patents are also hereby incorporated by reference in their entirety.

Developments in thin film field emission display technology have provided inexpensive low power devices with full color, high resolution and high contrast capabilities. With regard to reliability it is important to monitor operating parameters for the purpose of detecting failures such as inoperable emitter tips as well as investigating the causes thereof both before and after the display devices are vacuum packaged.

For detecting failures and for diagnostic purposes, it is important to be able to determine single pixel anode currents at a reasonably high speed and with good current measurement resolution.

SUMMARY OF THE INVENTION

The herein disclosed exemplary embodiments are directed to methods and systems for turning on one field emission display pixel at a time and measuring the current from that pixel as well as recording the current as to its amplitude or waveform and its location within the matrix. Moreover, it is an object of the exemplary embodiments to provide an anode current measuring circuit which is synchronized with the pixel driving circuit and which generates time sequence signals necessary to turn on a single pixel at a time in the field emission display device.

In a preferred embodiment of the system digital circuitry provides a time sequence signal for controlling the drive circuits of the field emission display device so that the display pixels are turned on one at a time. An anode current measuring circuit is synchronized with the display driving circuits and measures the anode current of the pixel which has been turned on. Both the drive circuits and the current measuring circuit are computer controlled such that different clock speeds may be set by way of programming for different operational modes such as a production mode wherein the pixels are scanned and the anode current measured at high speed. Alternatively, an engineering mode operated at a lower speed wherein the anode current wave form for a single pixel is recorded in the computer for detailed study of the emission characteristics of the selected pixel. Thus, the anode current measuring time for a single pixel can vary between a few microseconds to a few milliseconds depending upon the mode selected.

In accordance with another aspect, the herein disclosed exemplary embodiments pertain to various manners of measuring the single pixel anode current so as to obtain high speed measurement as well as low distortion notwithstanding the low currents to be measured and the necessary high speed driving of the pixels due to the large number of pixels in a conventional field emission display device.

The disclosed system can be used for testing display units for quality control and circuit diagnostic purposes in a vacuum probe station before the devices are packaged, thus leading to reduced production costs. Moreover, by using the herein disclosed system alone or in combination with optical tests, display devices can also be tested after packaging for determining the source of a problem, e.g. in the circuitry, the package or the phosphor screens. Such testing is faster and less expensive than optical tests alone and, accordingly, reduce production costs.

BRIEF DESCRIPTION OF THE DRAWINGS

The objects, features, advantages and characteristics of the present invention will become apparent from the following detailed description of the exemplary embodiments when read in light of the accompanying drawings wherein:

FIG. 4 illustrates an embodiment for measuring the single pixel anode current;

FIG. 5 illustrates a further embodiment of the current measuring circuit including an analog-to-digital converter for digitizing the anode current value;

DETAILED DESCRIPTION OF EXEMPLARY EMBODIMENTS

Figure 1:
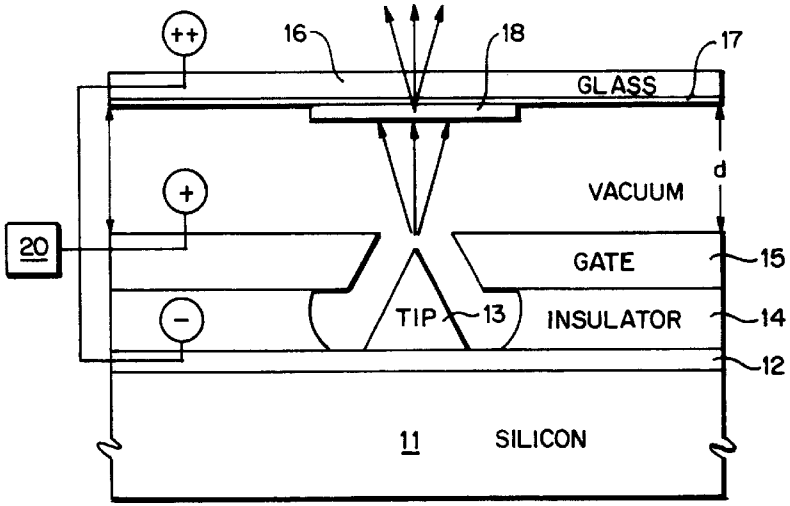
FIG. 1 is a cross-sectional drawing of a portion of a flat panel display illustrating a single field emission cathode.
Figure 2:
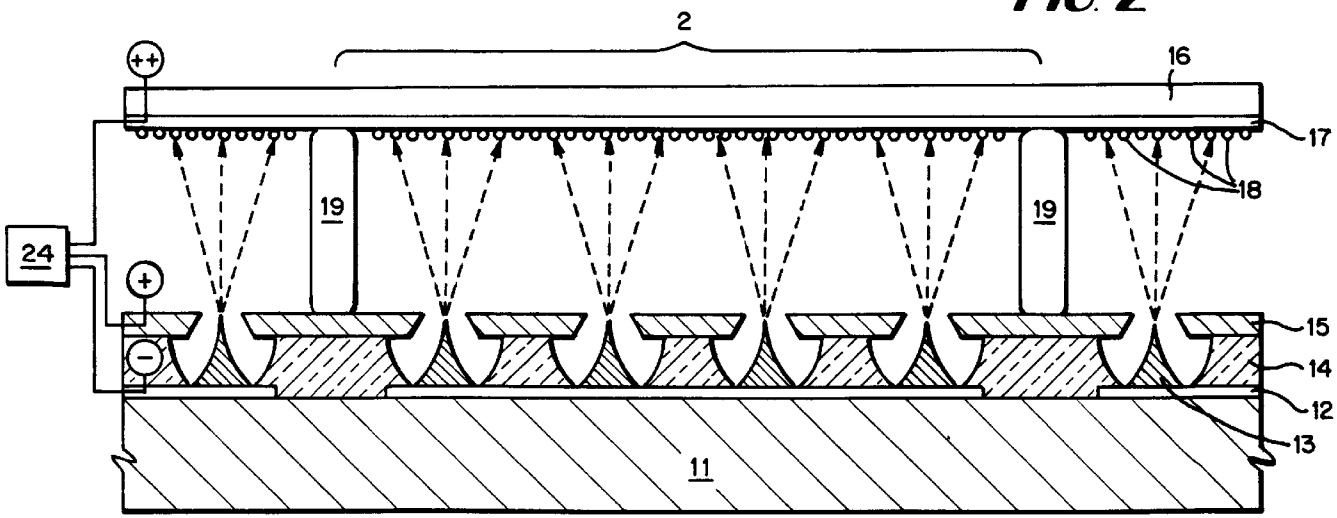
FIG. 2 is a larger cross-sectional schematic drawing of a portion of a flat panel field emission display illustrating the use of a plurality of cathode emitters associated with a single display pixel.
Figure 3:
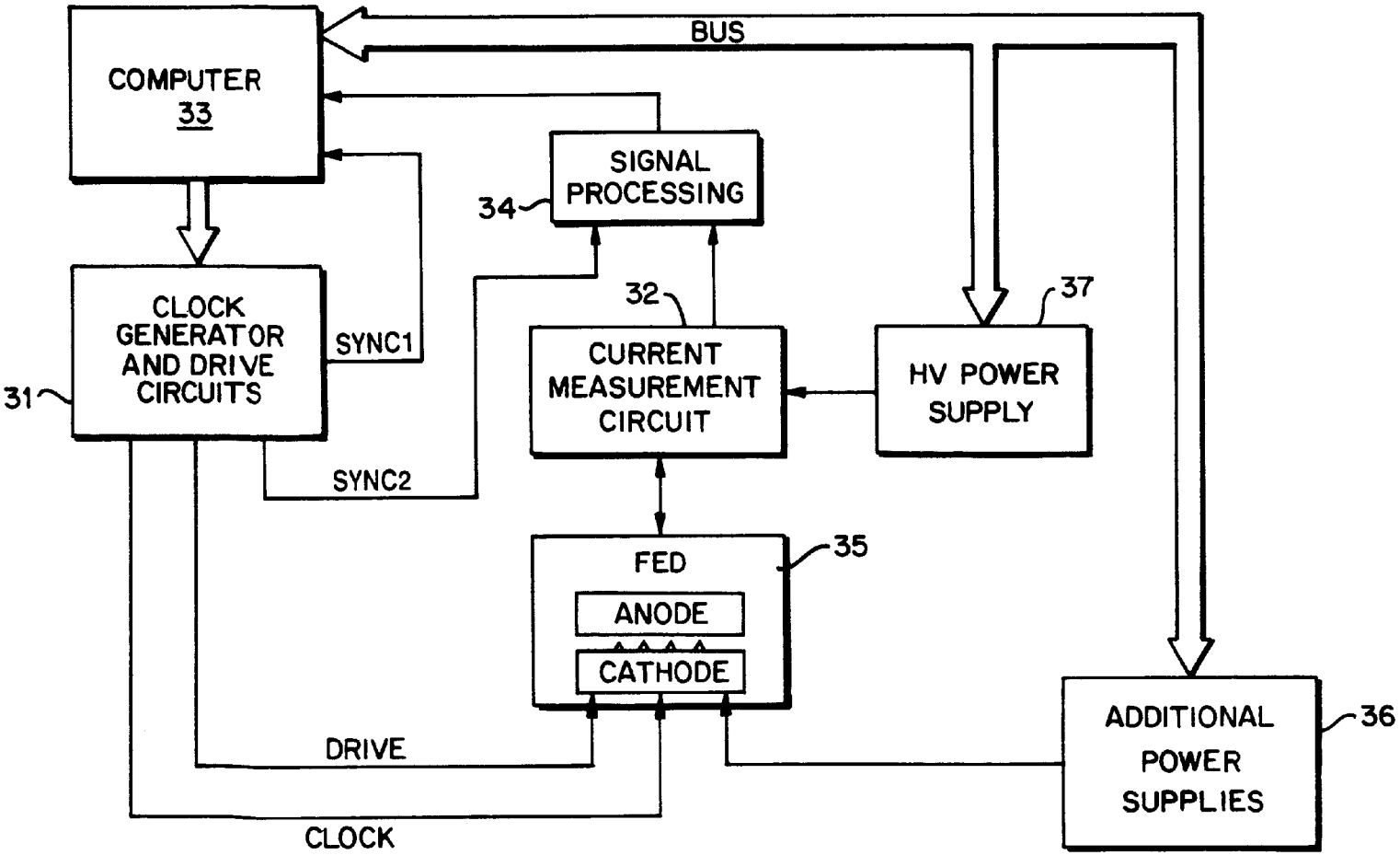
FIG. 3 illustrates the system diagram for producing time sequential signals for activating single pixels and for synchronously measuring and storing the anode current produced by the single pixel.

As aforementioned, with respect to FIGS. 1 and 2 field emission displays include a cathode having a larger number of emitters for providing electrons through field emission along with an anode which is covered by an electroluminescent coating. When one or more emitters associated with a pixel are turned on by drive circuitry, electrons from the activated emitters strike the anode which is biased at high positive voltage causing the electroluminescent layer to emit light at the corresponding pixel position of the display. Applicant's system as illustrated in FIG. 3, for example, is for the purpose of turning one field emission display pixel at a time and measuring the anode current from that pixel as well as recording it. Then, this pixel is turned off before the next pixel is turned on. Since a typical field emission display device can have hundreds of thousands of pixels and the anode current corresponding to a single pixel emission would only be in the hundreds of picoamperes to hundreds of nanoamperes, the testing apparatus is required to drive the pixels at a reasonably high speed along with obtaining proper current measurement resolution. Additionally, since the clock generators and display driving circuits 31 and the anode current measurement circuit 32 must be synchronized to properly associate a pixel, its corresponding anode current measurement and the pixel location, a computer processor 33 controls both circuits. That is to say, computer processor 33 controls which pixel is turned on as well as obtaining the corresponding anode current from the measuring circuit 32 by way of the signal processing interface circuit 34 so that the anode current measurement and its corresponding pixel location can be recorded.

It is additionally contemplated that the pixels of the field emission device 35 and the corresponding anode current measurements can use different clock sequences to implement different operational modes to activate the pixels one at a time at different speeds. In this regard a relatively slow engineering mode is contemplated wherein the computer processor will record the activated pixel location along with the current measurement waveform for detailed study of the emission characteristics of the corresponding pixel. Additionally, a higher speed production mode is contemplated. In this operational mode the current waveform is not recorded, only the average of the current pulse is read by the computer and "binning" is performed on this average current value for each pixel measurement which is thereafter classified into one of a plurality of divisions or bins wherein the average current response is determined and the bins may be representative of a plus or minus percentage of the average. Thus, the bins may represent a plus or minus 5% deviation from the average with further bins representing every additional 5% deviation. Sufficient deviation such as 20% from the average current response may be classified as a total failure level for the activated pixel. The single pixel time in these operational modes may vary between a few milliseconds and a few microseconds.

To accommodate for the different operational modes and clock speeds clock and control data is provided by the computer 33 to the clock generator and drive circuits 31 such that the different clocks can be set by programming a memory device in element 31 or the input frequency to a clock generator can be changed. Thus, digital timing circuit 31 provides appropriate timing and control signals to the drive circuits and clock generator to activate a desired pixel and to vary the single pixel timing depending upon the desired operational mode.

With regard to current measurement of the single pixel anode current, although the anode current can be measured on the low voltage side of the high voltage power supply 37, the frequency response of such measurements is limited by the high capacitance of the low voltage node of the power supply. Accordingly, in the preferred embodiment of the illustrated system, the single pixel anode current measurement is taken on the high voltage line of the power supply which may be 1–10 KV.

FIGS. 4 through 7 illustrate exemplary manners in which the single pixel anode current on the high voltage line can be measured. Each of these exemplary manners of anode current measurement are designed to obtain high speed measurement as well as low distortion since the anode current is relatively small, i.e., in a range of only a few hundred picoamperes to a few hundred nanoamperes depending upon the display size and the driving scheme employed for driving the pixels of the field emission device. Additionally, since the number of pixels for the field emission display devices is quite large, ranging from one to several hundred thousand, high speed measurements are also required.

FIG. 4 illustrates one manner of measuring the anode current of a single pixel. In this embodiment the measurement circuit 32 includes transconductance amplifier 40 along with a pair of voltage-to-frequency and frequency-to-voltage converters, 41 and 42, respectively, for high voltage isolation coupling between a high voltage side and a low voltage side of the measurement circuit. The transconductance amplifier is floated to the high voltage of the anode. That is to say, the voltage output by the amplifier which is representative of the anode current produced by a pixel being turned on is superimposed on a relative high voltage which must be coupled to a low voltage signal processing level with isolation such that the measurement signals can be processed and stored by the computer. Accordingly, the pair of converters 41 and 42 provide the coupling between output of the amplifier 40 and the signal processing circuit 34 with high voltage isolation. Conventional isolation devices may be incorporated such as an optical isolator, for example, for delivering low voltage signals to the signal processing circuit. Moreover, the signal processing circuit 34 would include an analog to digital converter so that the measured analog current values may be properly processed and stored by the computer. The advantage of this measurement circuit is the simplicity of the processing as well as the low power requirements on the high voltage side.

FIG. 5 illustrates an anode current measuring circuit including a transconductance amplifier 50 along with an analog to digital converter 51 which is included on the high voltage side wherein the anode current value is digitized. The digital anode current signal is thereafter coupled to the low voltage signal processing side with a voltage coupling device such as a high isolation voltage opto-isolator. The measured value is thereafter connected to the circuit 34 for appropriate signal processing for use by the computer 33. In this regard the signal processing circuit 34 will be responsive to background leakage of the cathode. Accordingly, the anode current when no pixels of the field emission display device are turned on may be measured and stored prior to turning on a pixel and the signal processing circuit 34 may include circuitry for subtracting the leakage current value from the anode current measured when one pixel is turned on. Similar signal processing to eliminate the cathode background leakage value may be utilized in the embodiment illustrated in FIG. 4.

The embodiment of FIG. 5 has the advantage of low noise generation since the signal produced by the amplifier 50 is immediately digitized after the current signal is converted to the voltage signal and prior to further processing.

Figure 6:
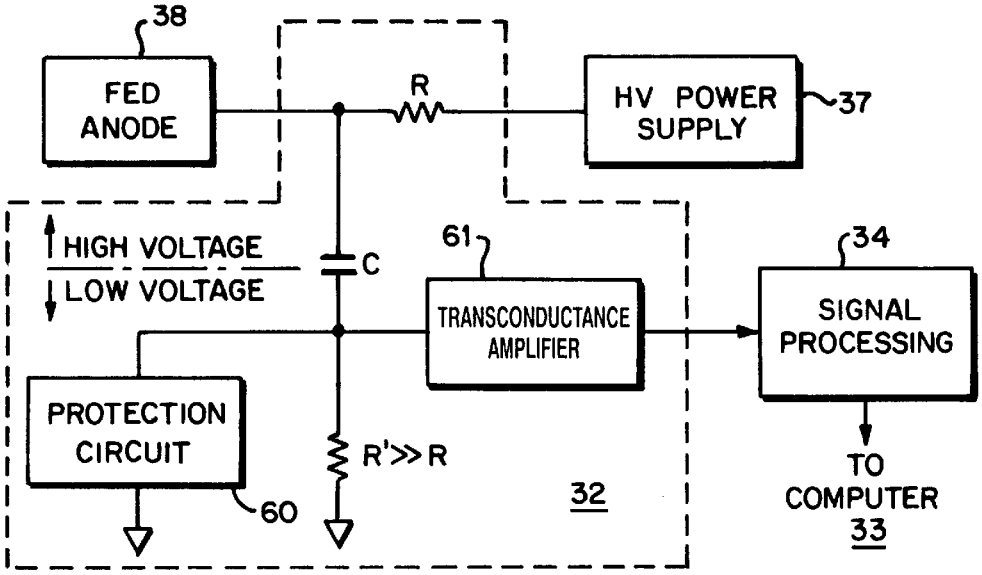
FIG. 6 illustrates a still further current measuring circuit which provides for protection from damage due to high voltage spikes as well as elimination of leakage current from the anode current readings.

FIG. 6 illustrates a further manner of measuring the anode current produced by the field emission display device when a single pixel is driven to an ON state. Measurement circuit 32 includes a resistor R which is connected between the anode power supply 37 and the anode of the field emission display device to limit the current flow between the high voltage power supply and the anode. Additionally, as illustrated in FIG. 6, a capacitor C is connected to the common node of the resistor and the anode. The other side of the capacitor is connected to a transconductance amplifier such that any time a current pulse appears on the high voltage side of the capacitor it is coupled through the capacitor to the low voltage side and the amplifier 61. Moreover, amplifier 61 produces an output voltage proportional to the current pulse which is thereafter received and digitized by the signal processing circuit 34 for use in the computer 33. A protection circuit 60 is additionally included in the circuit for passing any high voltage spike from the high voltage side of the capacitor which may be caused by a failure in the field emission display pixel components. Protection circuit 60 is used to pass any high voltage spike to ground and thus protect the amplifier.

In operation when no pixel of the field emission display is turned on, only a leakage current will flow through the resistor R. The leakage current, however, is either very low frequency or DC and thus will be blocked by capacitor C. Thus, subtraction of the leakage from the measured value is unnecessary when a pixel is turned on. The increased current produced by the pixel, although increasing the current flow through the resistor, will be limited since the voltage cannot change instantaneously. Thus, the current flow produced by the pixel will be supplied by the capacitor, and the amplifier will produce a voltage proportional thereto for processing by the signal processing circuit 34. In turn when the pixel is turned off, the capacitor will recharge. In this regard the duty cycle of the switching on and off of the pixels is kept sufficiently small such that the capacitor will have sufficient time to recharge. Moreover, the capacitance of the capacitance C should be sufficiently large that it will supply the current pulse with a corresponding drop in voltage across the capacitor. The advantages of the measurement circuit of FIG. 6 are that the capacitor acts as a high voltage to low voltage isolation device wherein no high voltage active device is required downstream of the capacitor. Moreover, the overall cost of the circuit of FIG. 6 is relatively low, and the frequency response of the circuit is limited only by the amplifier and the RC time. Additionally, the capacitor further acts to block the low frequency or DC leakage current of the cathode emitters.

Figure 7:
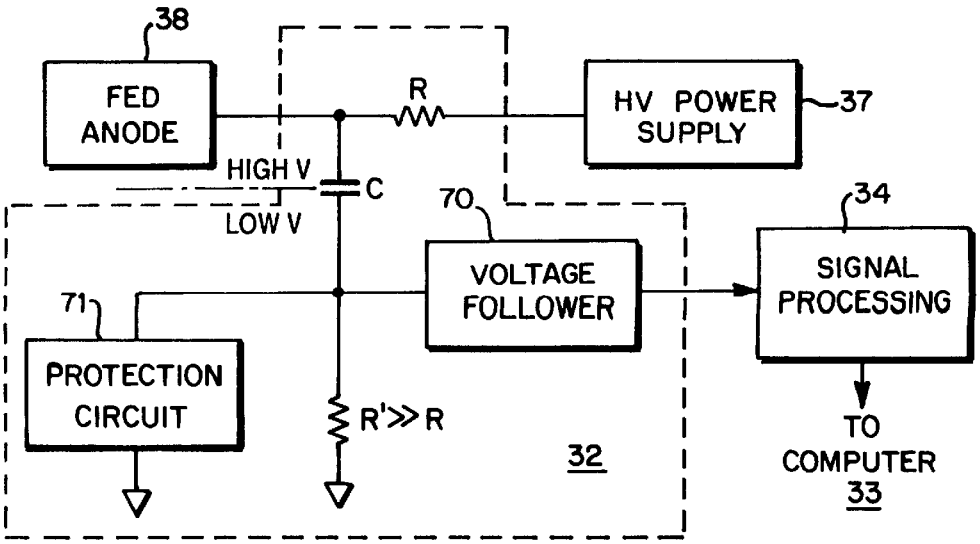
FIG. 7 illustrates a further current measuring circuit similar to that shown in FIG. 6 wherein a voltage follower has been substituted for the operational amplifier.

As shown in FIG. 7, a further anode current measuring circuit is illustrated. This circuit is similar to that which is illustrated in FIG. 6 except that the amplifier 61 of FIG. 6 is replaced by a voltage follower 70, and the resistance of the resistor R and the capacitance of the capacitor C are much smaller than the corresponding elements in FIG. 6. As in FIG. 6, a protection circuit 71 is included in order to protect the voltage follower from being damaged by high voltage spikes from the high voltage side of the capacitor due to a failure of the field emission display pixel elements. When no pixel of the display is on, only leakage current flows through the resistor R. However, when one of the display pixels is turned on, the current flow through the resistor will increase by the amount of anode current produced by the pixel. Under such conditions the voltage drop across the resistor will increase, and thus the voltage at the common node of the capacitor C, resistor R, and the anode will decrease by this amount, and the voltage follower will transfer this voltage pulse which is proportional to the pixel current to the signal processing circuit 34 for digitizing and storage of the measured value.

When the pixel is turned off, the anode current will drop to the leakage level and the resistor voltage drop will decrease. Correspondingly, the voltage at the common node of the resistor, capacitor and the anode will increase, and the voltage follower output will also increase. In this embodiment the resistance of the resistor should be sufficiently large to create enough of a voltage drop for measurement purposes. However, the resistance value should be much smaller than the input impedance of the voltage follower such that the capacitor will not be significantly discharged. Additionally, by using relatively small resistance and capacitance values with respect to that which is shown in FIG. 6, the capacitor couples voltage signals through to the voltage follower rather than coupling current as in the FIG. 6 embodiment. The measurement circuit of FIG. 7, however, has the advantages noted above with regard to the FIG. 6 embodiment as well as having the advantage of ease of adjustment of circuit parameters since the input impedance of the voltage follower is normally quite high.

Figure 8:
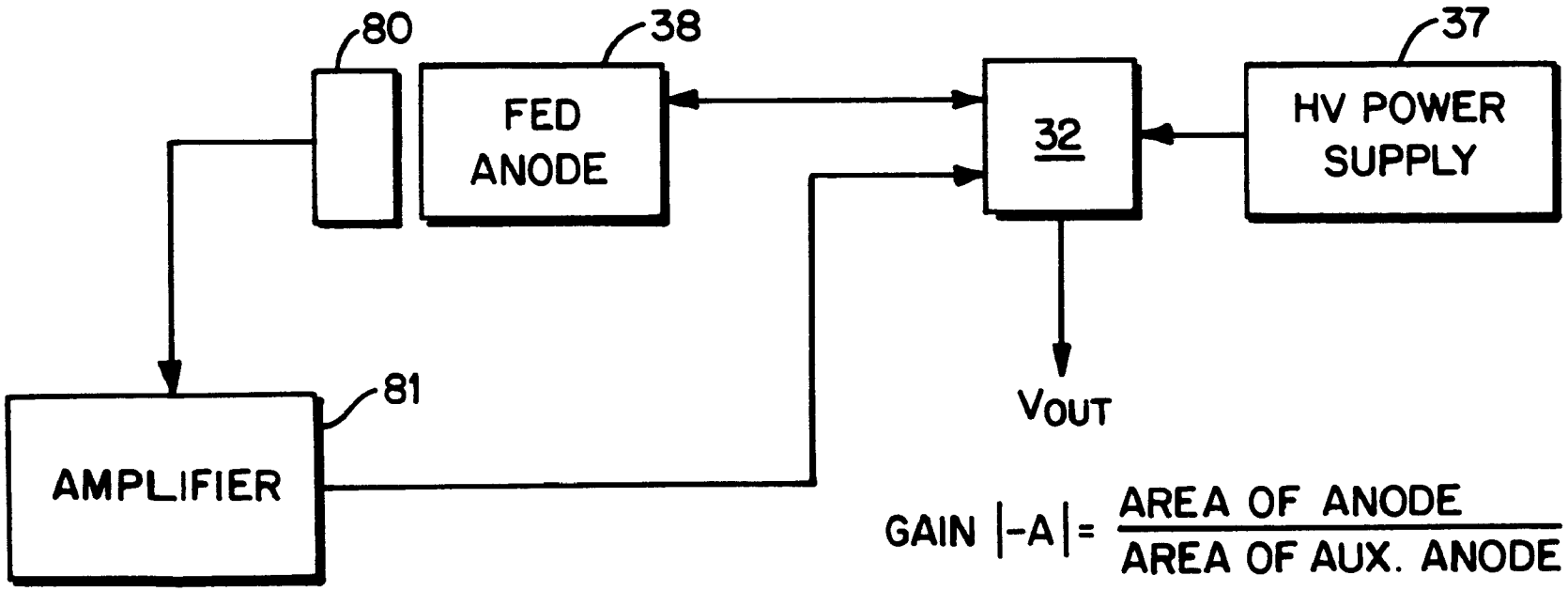
FIG. 8 illustrates additional circuitry involving an auxiliary anode for the field emission device whereby noise can be canceled from the anode signal used for anode current measurement.

FIG. 8 illustrates an anode signal noise cancellation circuit which may be used in conjunction with the anode current measuring circuit 32 through the use of an auxiliary anode for detecting high frequency signals coupled to the anode due to the high frequency drive signals, and the very short distance between the anode and cathode as found in field emission display devices. Depending on the size of the display device such AC coupling can make it difficult to measure very small anode currents when only a single pixel is turned on. In order to eliminate the high frequency signals coupled to the anode, an auxiliary anode 80 is placed on top of the field emission device anode 38 and in close proximity thereto so as to pick up the coupled high frequency signal. This signal is then inverted and amplified by amplifier 81 with a gain which is proportional to the ratio of the area of the anode 38 to the area of the auxiliary anode. Thus, the signal produced by the amplifier 81 would have the same amplitude as that of the AC signal coupled to the anode 38 but inverted. This signal produced by the amplifier 81 can then be used in the measurement circuit operational amplifier, for example, to effectively cancel the noise on the signal produced by the anode 38.

Where the field emission display device is packaged as a sealed evacuated panel, the auxiliary anode 80 may be placed on top of the anode 38 outside the package such that the high frequency noise is coupled thereto. Alternatively, where the field emission device is not packaged but is being tested in an evacuated probe station, the auxiliary anode 80 may be placed on top of the field emission display anode 38 in close proximity thereto. In either event, although the current in the auxiliary anode would not fluctuate due to the cathode emissions since there is no direct connection between elements 80 and 38, both the anode 38 and the auxiliary anode 80 would fluctuate in response to the high frequency noise. However, since the auxiliary anode signal would be representative only of the noise signal, it can be fed back by way of amplifier 81 to cancel the noise in the measurement circuit.

While applicant's invention has been described in what is presently considered to be the most practical and preferred exemplary embodiments, it is to be understood that the invention is not intended to be limited to the disclosed embodiments but is intended to cover various modifications and equivalent arrangements included within the spirit and scope of the appended claims.

What is claimed is:

1. A system for measuring single pixel anode current in a field emission display, said system comprising:

a high voltage source connected to an anode of the field emission display;

display drive circuits for turning on one display pixel of the field emission display at a time;

a current measuring circuit connected to the high voltage source for measuring anode current produced by the field emission display in response to the display drive circuits turning on one display pixel at a time; and signal processing circuits responsive to said current measuring circuit for producing digitized values of the measured anode current in a form suitable for storage in a memory of a computer.

2. The system as in claim 1 further comprising:

digital circuitry for controlling the timing of the display drive circuits to operate at one of a plurality of selectable driving speeds.

3. The system as in claim 1 wherein the display driving circuits include a clock generator and the current measuring circuit is synchronized with the display driving circuits.

4. A system as in claim 1 further comprising:

digital circuitry for producing a timing sequence signal for causing the current measuring circuit to measure the anode current one pixel at a time.

5. The system as in claim 1 wherein the current measuring circuit includes a means for producing a voltage proportional to the measured anode current, the voltage being isolated from the high voltage source.

6. The system as in claim 1 wherein the current measuring circuit includes a transductance amplifier for producing a voltage proportional to the measured anode current, a voltage to frequency converter connected to receive the voltage and a frequency to voltage converter for providing a low voltage proportional to the measured anode current, the low voltage being isolated from the high voltage source.

7. The system as in claim 1 wherein the current measuring circuit includes a resistance-capacitance circuit connected between the high voltage source and the field emission display anode, and an operational amplifier connected to the resistance-capacitive circuit for producing a voltage proportional to the measured anode current, wherein the resistance-capacitance circuit isolates the operational amplifier from the high voltage source.

8. The system as in claim 1 wherein the current measuring circuit includes a resistance-capacitance circuit connected between the high voltage source and the field emission display anode, and a voltage follower connected to the resistance-capacitive circuit for producing a voltage proportional to the measured anode current, wherein the resistance-capacitance circuit isolates the voltage follower from the high voltage source.

9. The system as in claim 2 wherein the digital circuitry is a computer.

10. The system as in claim 4 wherein the digital circuitry is a computer including a memory for storing the value of the measured current and the display location on the display of the pixel producing the measured current.

11. A system for measuring single pixel anode current in a field emission display, said system comprising:

a high voltage source connected to an anode of the field emission display, display drive circuits for turning on one display pixel of the field emission display at a time;

a current measuring circuit connected to the high voltage source for measuring anode current produced by the field emission display in response to the display drive circuits turning on one display pixel at a time; and memory circuits for storing the value of the measured current and the display location on the display of the pixel producing the measured current.

12. A system for measuring single pixel anode current in a field emission display, said system comprising:

a high voltage source connected to an anode of the field emission display;

display drive circuits for turning on one display pixel of the field emission display at a time: and a current measuring circuit connected to the high voltage source for measuring anode current produced by the field emission display in response to the display drive circuits turning on one display pixel at a time, wherein the current measuring circuit includes a transconductance amplifier for producing a voltage proportional to the measured anode current, an analog to digital converter for digitizing the voltage and wherein the digitized voltage is isolated from the high voltage source.

13. A system for measuring single pixel anode current in a field emission display, said system comprising:

high voltage source connected to an anode of the field emission display;

display drive circuits for turning on one display pixel of the field emission display at a time;

a current measuring circuit connected to the high voltage source for measuring anode current produced by the field emission display in response to the display drive circuits turning on one display pixel at a time;

an auxiliary anode associated with the field emission display for sensing high frequency noise coupled thereto; and means for producing an inverted signal proportional to the high frequency noise for canceling the noise from the measured anode current.

14. A system for measuring single pixel anode current in a field emission display, said system comprising:

a high voltage source connected to an anode of the field emission display;

display drive circuits for turning on one display pixel of the field emission display at a time;

a current measuring circuit connected to the high voltage source for measuring anode current produced by the field emission display in response to the display drive circuits turning on one display pixel at a time; and signal processing circuits configured to cancel a leakage current produced by the field emission display from the measured anode current.

15. A method for measuring single pixel anode current in a field emission display having a plurality of display pixels, the method including the steps of:

connecting a high voltage source to an anode of a field emission display;

utilizing display drive circuits to turn on one display pixel of the field emission device at a time;

measuring anode current from the high voltage source produced by the said field emission display in response to the display drive circuits turning on one display pixel at a time; and digitizing the measured anode current in a form suitable for storage in a memory device.

16. The method of claim 15, including the further step of controlling timing of the display drive circuits to operate at one of a plurality of selectable driving speeds.

17. The method of claim 15, including the further step of synchronizing the display drive circuits and the measuring of anode current produced by the field emission display.

18. The method of claim 15, including the further step of producing a timing sequence signal for causing the anode current to be measured one pixel at a time.

19. The method of claim 15, wherein the measuring step produces a voltage proportional to the measured anode current, and wherein the proportional voltage is isolated from the high voltage source.

20. The method of claim 19, wherein a transconductance amplifier is utilized to produce a voltage proportional to the measured anode current, a voltage to frequency converter receives the proportional voltage to produce a corresponding frequency signal, and a frequency to voltage converter receives the frequency signal and produces a low voltage signal proportional to the measured anode current.

21. The method of claim 15, wherein the measuring step utilizes a current measuring circuit including a resistance-capacitance circuit connected between the high voltage source and the field emission display anode and an operational amplifier connected to the resistance-capacitance circuit to produce a voltage proportional to the measured anode current, wherein the resistance-capacitance circuit isolates the operational amplifier from the high voltage source.

22. A method for measuring single pixel anode current in a field emission display having a plurality of display pixels, the method including the steps of:

connecting a high voltage source to an anode of a field emission display;

utilizing display drive circuits to turn on one display pixel of the field emission device at a time;

measuring anode current from the high voltage source produced by the field emission display in response to the display drive circuits turning on one display pixel at a time;

sensing high frequency noise; and canceling the sensed high frequency noise from the measured anode current.

23. A method for measuring single pixel anode current in a field emission display having a plurality of display pixels the method including the steps of:

connecting a high voltage source to an anode of a field emission display;

utilizing display drive circuits to turn on one display pixel of the field emission device at a time;

measuring anode current from the high voltage source produced by the field emission display in response to the display drive circuits turning on one display pixel at a time; and canceling leakage currents produced by the field emission display from the measured anode current.

24. An apparatus for detecting defects in field emission displays having a plurality of field emitter cathodes, an extraction gate, and a phosphor coated display screen which operates as a field emission device anode such that, when one or more field emitter cathode is selectively energized by display drive circuits, an electron stream is emitted toward the phosphor coated display screen to illuminate a corresponding one of a plurality of display pixels, said apparatus comprising:

a high voltage source coupled with said display screen to provide a high voltage positive bias on said field emission display anode;

a processor operable to control said display drive circuits to selectively energize one or more field emitter cathodes associated with an individual pixel such that said display pixels are turned on one at a time to thereby cause electrons from said one or more emitter cathodes to strike said field emission anode at the corresponding pixel position of the display; and a current measuring circuit operable to measure anode current produced by the field emission display in response to said pixels being turned on one pixel at a time, said processor controlling said current measuring circuit to operate in synchronism with said display drive circuits.

25. The apparatus of claim 24, wherein said processor controls the timing of said display drive circuits to operate at one of a plurality of selectable driving speeds.

26. The apparatus of claim 24, further including a circuit responsive to said current measuring circuit for producing digitized values of the measured anode current in a form suitable for storage in a computer memory device.

27. The apparatus of claim 26, wherein said digitized values are stored in a computer memory device along with information indicating the corresponding pixel location.

* * * * *